US009635888B2

(12) United States Patent
Ishihara et al.

(10) Patent No.: US 9,635,888 B2
(45) **Date of Patent: *May 2, 2017**

(54) ARTICLE OF APPAREL INCORPORATING A COVERED ELECTRONIC DEVICE

(71) Applicant: Nike, Inc., Beaverton, OR (US)

(72) Inventors: James Alec Ishihara, Beaverton, OR (US); YeongKyu Yoo, Beaverton, OR (US); Edward Lang Boyd, Portland, OR (US)

(73) Assignee: Nike, Inc., Beaverton, OR (US)

( * ) Notice: Subject to any disclaimer, the term of this patent is extended or adjusted under 35 U.S.C. 154(b) by 508 days.

This patent is subject to a terminal disclaimer.

(21) Appl. No.: 14/173,026

(22) Filed: Feb. 5, 2014

(65) Prior Publication Data

US 2014/0151416 A1 Jun. 5, 2014

Related U.S. Application Data

(63) Continuation of application No. 11/358,743, filed on Feb. 22, 2006, now Pat. No. 8,677,515.

(51) Int. Cl.
*A41D 1/00* (2006.01)
*A44C 5/00* (2006.01)
(Continued)

(52) U.S. Cl.
CPC ..... *A41D 1/002* (2013.01); *A44C 5/0015* (2013.01); *A44C 5/0053* (2013.01); *G04B 37/12* (2013.01);
(Continued)

(58) Field of Classification Search
CPC .... A41D 1/002; A44C 5/0015; A44C 5/0053; G04B 37/12; G04B 37/1433; G04B 37/1486; G04B 45/00
(Continued)

(56) References Cited

U.S. PATENT DOCUMENTS 1,271,735 A * 7/1918 Lockwood ..... G04B 19/30
116/DIG. 36
1,309,988 A * 7/1919 Knyvelt ..... G04B 37/0025
224/170
(Continued)

FOREIGN PATENT DOCUMENTS

CH 536083 4/1973
CH 685586 8/1995
(Continued)

OTHER PUBLICATIONS

PCT/US2005/036666, International Search Report mailed Feb. 23, 2006.

*Primary Examiner* — Alissa L Hoey
(74) *Attorney, Agent, or Firm* — Banner & Witcoff, Ltd.

(57) ABSTRACT

An article of apparel is disclosed that includes a covered electronic device. The apparel is at least partially formed from a material element that defines an aperture. The electronic device is locatable within the aperture and secured to the material element. A material covers the electronic device such that the electronic device cannot be seen. Upon activation of the electronic device, the readout is seen through the material. The electronic device may be a timing device, such as a watch, or a global positioning system unit. The apparel may be a wristband formed from a polymer material or any of a variety of other types of apparel.

11 Claims, 7 Drawing Sheets

(51) Int. Cl.
*G04B 37/12* (2006.01)
*G04B 37/14* (2006.01)

(52) U.S. Cl.
CPC ..... *G04B 37/1433* (2013.01); *G04B 37/1486* (2013.01)

(58) Field of Classification Search
USPC ..... 2/162, 170
See application file for complete search history.

(56) References Cited

U.S. PATENT DOCUMENTS 1,374,257 A 4/1921 Raalte
1,416,654 A 5/1922 Lenneberg
1,479,008 A * 1/1924 Powers ..... G04B 37/1433 224/152
1,763,929 A 6/1930 Kellner
1,857,195 A 5/1932 Karpf
2,076,221 A 4/1937 Bradbury
2,103,711 A 12/1937 Cole
2,182,830 A 12/1939 Vedder
2,227,131 A 12/1940 Friedman
2,249,550 A 7/1941 Williams
2,333,428 A 11/1943 Kinsey
2,344,136 A 3/1944 Dressen
2,511,105 A * 6/1950 Fenyvessy ..... G04B 37/1433 2/249
2,643,389 A 6/1953 Wegner
3,018,614 A * 1/1962 Brien ..... G04B 19/30 362/190
3,365,877 A * 1/1968 Altman ..... A44C 17/02 224/170
3,547,323 A 12/1970 Sledge, Jr. et al.
3,911,666 A * 10/1975 Haber ..... G04C 3/002 200/52 R
3,924,400 A * 12/1975 Carlone ..... G04C 3/001 368/225
4,023,347 A * 5/1977 Haber ..... G04G 17/08 368/224
4,060,185 A 11/1977 Kuroda
4,117,662 A 10/1978 van der Lely
4,155,219 A 5/1979 Anderson
4,229,936 A * 10/1980 Schneider ..... A44C 5/0053 368/280
4,281,389 A 7/1981 Smith
4,326,280 A * 4/1982 Perry, Jr. ..... A45F 5/02 224/163
4,387,838 A 6/1983 Jackson
4,509,644 A 4/1985 Kulick
D281,674 S 12/1985 Novak
D287,229 S 12/1986 Hallman et al.
4,627,739 A 12/1986 Shingo et al.
4,645,102 A 2/1987 Proellochs et al.
4,684,264 A 8/1987 Paperno et al.
4,685,599 A 8/1987 Israel et al.
4,761,835 A 8/1988 Chen
4,766,611 A 8/1988 Kim
4,769,799 A 9/1988 Matsukage et al.
4,779,249 A * 10/1988 Rappaport ..... G04B 37/1486 224/178
4,862,521 A 9/1989 Mann
4,916,679 A * 4/1990 Agnello ..... G04B 47/00 368/283
4,918,759 A 4/1990 Anderson et al.
4,922,850 A 5/1990 Conley
5,035,000 A 7/1991 Matthias
5,117,508 A 6/1992 Gunter
D330,679 S 11/1992 Bland
D335,023 S 4/1993 Hutcheson
5,265,071 A * 11/1993 Thorgersen ..... G04B 19/30 362/23.15
D341,972 S 12/1993 Tiramani et al.
5,272,682 A 12/1993 Falcone
5,332,135 A 7/1994 Fletcher
5,377,046 A 12/1994 Ryan
D355,132 S 2/1995 Williams
5,548,565 A * 8/1996 Aoyama ..... G04B 47/00 362/103
5,584,133 A 12/1996 Motooka et al.
5,610,877 A 3/1997 Adams et al.
5,623,731 A 4/1997 Ehrgott et al.
5,684,758 A 11/1997 Gray et al.
5,704,067 A 1/1998 Brady
5,734,627 A * 3/1998 Sy ..... G04B 19/30 313/113
5,738,526 A 4/1998 Cerda et al.
5,749,841 A 5/1998 Moore
5,775,011 A 7/1998 Reitano, Jr.
5,805,533 A * 9/1998 Daigle ..... G04B 19/30 368/226
5,812,500 A 9/1998 Webb, Jr.
5,838,639 A * 11/1998 Hwang ..... G04B 47/00 368/10
5,838,642 A 11/1998 Tully
5,848,030 A 12/1998 Sullivan
5,917,278 A * 6/1999 Miyauchi ..... H05B 33/26 313/506
5,920,364 A * 7/1999 Akins ..... G02F 1/13718 349/110
5,924,135 A 7/1999 Worth
5,966,344 A * 10/1999 Umemoto ..... G04B 19/12 368/227
6,079,049 A 6/2000 Moir
6,199,730 B1 3/2001 Chisolm
6,213,634 B1 4/2001 Harrington et al.
6,234,668 B1 5/2001 Cooper
6,272,075 B1 8/2001 Paganelli et al.
6,519,207 B1 2/2003 Lukacsko
D471,114 S 3/2003 Chong
6,561,814 B2 5/2003 Tilbury et al.
6,563,424 B1 5/2003 Kaario
6,565,253 B1 * 5/2003 Yang ..... G04G 21/00 368/227
6,621,766 B2 * 9/2003 Brewer ..... G02B 26/026 368/10
6,685,634 B1 2/2004 Fry
6,728,971 B1 5/2004 Benzvidez
6,799,887 B1 10/2004 Kinney
6,870,796 B2 3/2005 Elling
D503,895 S 4/2005 Black
6,895,261 B1 5/2005 Palamides
7,041,032 B1 5/2006 Calvano
7,120,936 B2 10/2006 DeSantis
7,124,447 B2 10/2006 Arganese
7,168,098 B2 1/2007 West
7,175,340 B1 * 2/2007 Kinney ..... G04B 37/1486 368/281
7,252,215 B1 8/2007 Furnas, II
D564,372 S 3/2008 Bhavnani
7,380,287 B2 6/2008 DeSantis
7,682,070 B2 * 3/2010 Burton ..... G04B 37/0008 368/294
7,793,361 B2 * 9/2010 Ishihara ..... A41D 1/002 2/170
8,209,776 B1 * 7/2012 Aragon ..... A41D 20/00 2/16
8,677,515 B2 * 3/2014 Ishihara ..... A44C 5/0015 2/125
8,811,123 B2 * 8/2014 Gough ..... G04G 17/08 368/10
2003/0213045 A1 * 11/2003 Fuentes ..... A41D 13/01 2/69
2004/0040872 A1 3/2004 Christie
2004/0190383 A1 * 9/2004 Marcucelli ..... G04G 17/08 368/278
2005/0246823 A1 11/2005 Groom
2006/0062090 A1 * 3/2006 Ast ..... G04B 39/008 368/296
2006/0117458 A1 6/2006 Ishihara et al.
2007/0107456 A1 5/2007 Yeager

(56) References Cited

U.S. PATENT DOCUMENTS

| | | | | |
|---|---|---|---|---|
| 2007/0139875 | A1* | 6/2007 | Carstens | G06F 1/163 361/679.01 |
| 2007/0245444 | A1 | 10/2007 | Brink | |
| 2007/0261703 | A1 | 11/2007 | Gheneva et al. | |
| 2009/0074224 | A1 | 3/2009 | Wright | |
| 2009/0163255 | A1* | 6/2009 | Sadler | H04M 1/0283 455/575.1 |
| 2012/0036893 | A1* | 2/2012 | Forero | A44C 5/0015 63/3 |
| 2012/0305770 | A1* | 12/2012 | Minera | G09F 13/22 250/330 |
| 2013/0174320 | A1* | 7/2013 | Moye | A41D 27/20 2/170 |
| 2013/0276210 | A1* | 10/2013 | Clarke | A41D 1/08 2/220 |
| 2014/0196194 | A1* | 7/2014 | Clarke | A41D 1/14 2/237 |

FOREIGN PATENT DOCUMENTS

| | | | | |
|---|---|---|---|---|
| DE | 29616787 | | 3/1997 | |
| EP | 1752840 | A2 * | 2/2007 | G02F 1/167 |

* cited by examiner

ARTICLE OF APPAREL INCORPORATING A COVERED ELECTRONIC DEVICE

This application is a continuation of application Ser. No. 11/358,743, filed Feb. 22, 2006, which application is hereby incorporated by reference in its entirety.

FIELD OF THE INVENTION

The present invention relates to apparel. Aspects of the invention concern, more particularly, an article of apparel that incorporates an electronic device that is hidden by and viewed through material.

BACKGROUND OF THE INVENTION

Athletes utilize a variety of electronic devices to assist with training exercises or competitions. For example, an athlete may make use of a timing device to track and display time, record split or lap times, provide chronographic data, or function as an alarm. Global positioning systems may also be utilized to calculate distances and, in combination with a watch or other timing device, calculate an average velocity. In addition, the electronic devices may function to gauge the temperature of surrounding air, determine altitude or direction, monitor heart rate, facilitate communication between two or more individuals, provide audible signals to pace the velocity of the wearer, or display the date. Accordingly, a variety of electronic devices may be utilized during training exercises or competitions to assist the athlete or impart an advantage to the athlete.

Each of the electronic devices discussed above may be incorporated into a wrist-mounted unit. As an example, a timing device (i.e., a watch) may include an electronic timing element, a case, and a band. The electronic timing element is located within the case and functions to track the time and display the time for a wearer or another individual. The case functions to protect the electronic timing element and often includes a transparent face for viewing a time display on the electronic timing element. The band extends from opposite sides of the case and secures the case and electronic timing element to a wrist of the wearer.

Although a majority of watches include the electronic timing element, case, and band, modern watch designs include a plurality of variations upon these components. The electronic timing element, for example, may be replaced by a mechanical movement or an element with a combination of mechanical and electrical features. The band may incorporate a clasp that secures the watch to the wrist, or the band may exhibit an open, bracelet-like configuration. Furthermore, the materials that form the various components may include both polymers and metals, for example. Differences in the various elements forming watches may be utilized, for example, to provide enhanced utility to the wearer, decrease the mass of the watch, or enhance the aesthetic appeal of the watch.

BRIEF SUMMARY OF THE INVENTION

Aspects of the present invention include an article of apparel, such as a wristband or jacket that includes an electronic device. The apparel is at least partially formed from a material element that defines an aperture. The electronic device is locatable within the aperture and permanently or removably-securable to the material element. A flexible material covers the electronic device such that the electronic device is not seen. Upon activation of the electronic device, the readout of the electronic device is visible through the material. The electronic device may be a timing device, such as a watch, or a global positioning system unit.

The material covering the face of the electronic device may be permanently or temporarily affixed to the apparel. The electronic device is activated through the material. When activated, the display of the electronic device is visible through the material.

The electronic element may be removed from the aperture. When removed, the apparel may be subjected to a washing process in the absence of the electronic element. Also, the electronic element may be interchanged with another electronic element.

BRIEF DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
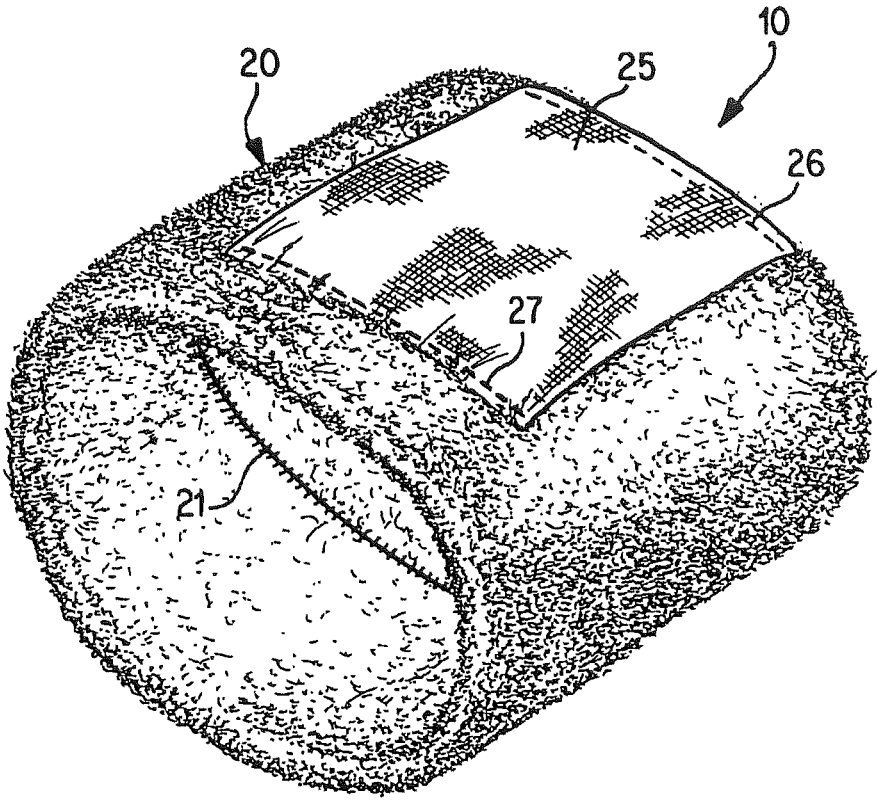
FIG. 1 is a perspective view of a first article of apparel in accordance with an aspect of the present invention.

The following discussion and accompanying figures disclose various articles of apparel that incorporate an electronic device and have a covering material that covers the electronic device. The articles of apparel and electronic devices include those described in co-pending application Ser. No. 10/987,577 which is hereby incorporated by reference in its entirety.

In general, the articles of apparel are formed from a material element, such as a textile or polymer sheet, that defines an aperture. The electronic device may be positioned within the aperture and secured to the material element. In addition, the electronic device may be detached from the material element and removed from the aperture. That is, the electronic device may be separated from a remainder of the article of apparel. This configuration permits the remainder of the article of apparel, including the material element, to go through a washing process in the absence of the electronic device, thereby decreasing the probability of damaging the electronic device during the washing process. This configuration also permits the electronic device to be interchanged with one of a plurality of other electronic devices that perform a different function.

In particular, a flexible covering material is attached to the material element so that the covering material at least partially covers the face of the electronic device such that the electronic device cannot be seen when the apparel is being worn. This allows the user to wear the apparel with the electronic device unseen. When the electronic device is activated, the display is at least partially visible through the material and is readable. The display may be modifiable between an unilluminated and illuminated configuration. The covering material is sufficiently flexible in that the material can partially conform against the electronic device. This allows the display to be read through the covering material. If the covering material is too stiff, the material may not conform against the display and the display may not be seen through the material.

The covering material may be permanently attached, such as sewn, or removably attached, such as with Velcro. Of course combinations of permanent and removable attachment may be used such as the covering material being sewn onto the material element at one end and attached by Velcro at another end.

The material covering the electronic device protects the device from harm such as being scratched. The material is lightweight and allows light from the electronic device, e.g. LED, to shine or glow through the material in such a manner that the display can be read. The electronic device can be activated through the material by touch, e.g. depressing a display button. Thus, the material should be sufficiently flexible to allow the user to activate the electronic device through the covering material. The electronic device can be activated underneath the material by touch if only a portion of the material is attached to the material element. Again, the material should be sufficiently flexible to allow the user to activate the electronic device underneath the material.

Figure 2:
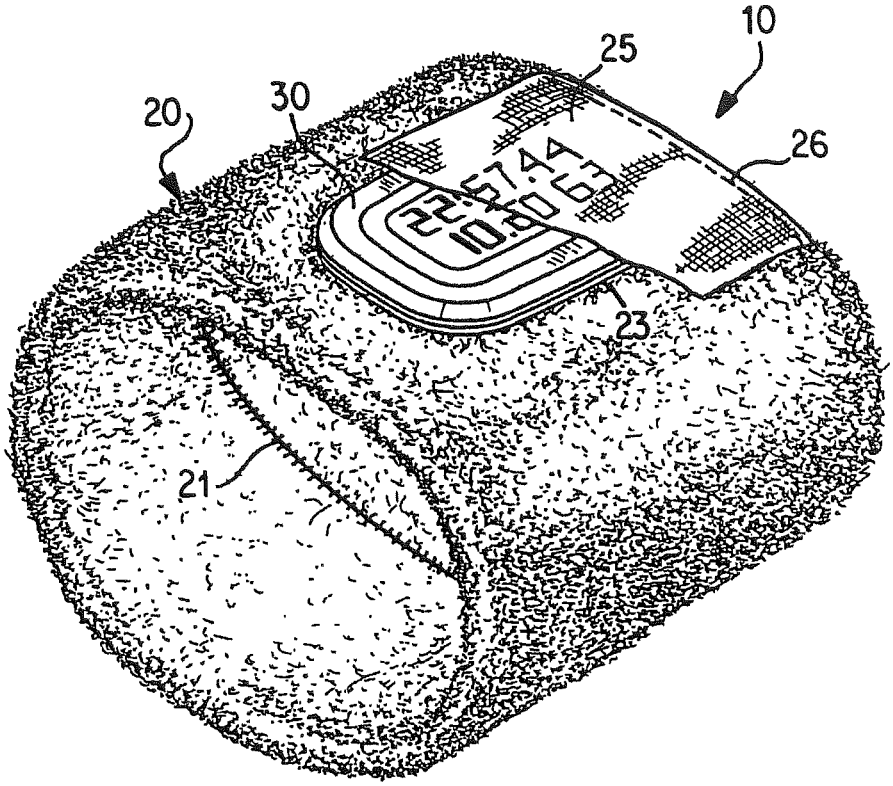
FIG. 2 is a perspective view of the first article of apparel in accordance with an aspect of the present invention wherein the covering material is partially cut away to view the hidden electronic device.
Figure 3:
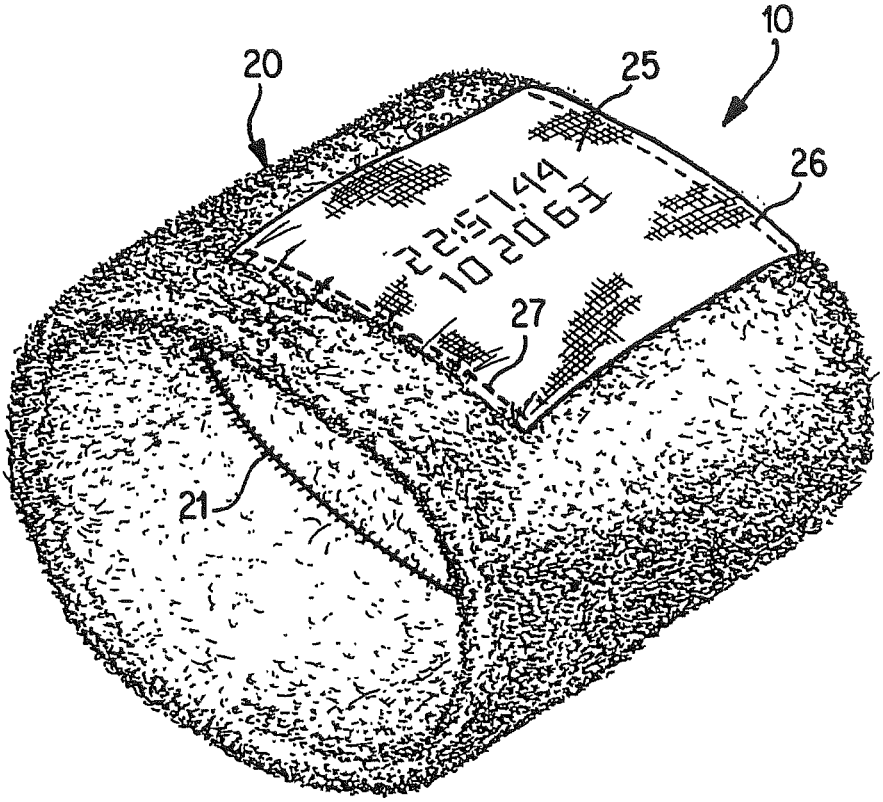
FIG. 3 is a perspective view of the first article of apparel in accordance with an aspect of the present invention wherein the display of the electronic device is visible through the material.

An article of apparel 10 is depicted in FIG. 1 as including a wristband 20 and a covering material 25 attached to the wristband. As depicted in FIG. 2, an electronic device 30 is attached to the wristband, and covering material 25, shown partially covering the electronic device 30. FIG. 3 shows the wrist band 20 having covering material 25 attached to the wristband and the display of the electronic device being visible through the material.

In general, apparel 10 forms a dual-purpose device that may assist athletes with training exercises or competitions. For example, wristband 20 may be utilized to absorb and remove perspiration or other moisture from areas proximal the face of the athlete, and electronic device 30 may be utilized to track and display time, record split or lap times, provide chronographic data, or facilitate communication between two or more individuals (i.e., as a wireless phone or two-way communication device).

Following the training exercises or competitions, electronic device 30 may be separated from wristband 20 in order to permit wristband 20 and covering material 25 to go through a washing process in the absence of electronic device 30. Alternately, for example, electronic device 30 may be interchanged with another electronic device. In some embodiments, electronic device 30 may be permanently affixed to wristband 20.

Wristband 20 is at least partially formed from a textile material, for example, and exhibits the general configuration of a conventional wristband. Accordingly, the textile material forming wristband 20 forms a looped or generally cylindrical structure having interior dimensions that approximate dimensions of a wrist.

Although a variety of textile materials are suitable for wristband 20, exemplar textile materials include either a single-sided terry knit textile or a double-sided terry knit textile. Yarns forming the terry knit textile may be formed from fibers and filaments that include natural, synthetic, or combinations of natural and synthetic materials. More particularly, the various terry loops that characterize the terry knit textile may be formed from cotton yarns to promote moisture-absorption and comfort. Other portions of the textile material forming wristband 20 may incorporate an elastic fiber that enhances the stretch and recovery properties of wristband 20, thereby permitting the circumference of wristband 20 to expand and contact in order to assist with placing apparel 10 upon the wrist and accommodate wrists of different size. A suitable elastic fiber is formed from elastane, which is available from E.I. duPont de Nemours Company under the L YCRA trademark.

Other material elements, in addition to the textile materials discussed above, may be utilized for wristband 20. Wristband 20 may be formed from one or more elements of textile materials that form the looped or generally cylindrical structure. As depicted in FIGS. 1-5, wristband 20 may be formed from a tubular structure of textile material that is folded inward to form a seam 21 circumscribing an interior surface of wristband 20. Alternately, wrist band 20 may have a non-folded configuration, or wristband 20 may be formed from a planar element of textile material with joined ends that form a seam extending perpendicular to seam 21.

Based upon the above discussion, therefore, wrist band 20 may be formed in a variety of ways and may exhibit a variety of configurations within the scope of the present invention.

The covering material 25 at least partially covers the face of the electronic device 30 and is attached to the wrist band 20. When the electronic device 30 is activated, the display glows through the material and is readable. The covering material may be attached only to the top side of the wristband, for example, or may curve under and be attached to the underside of the wristband.

The covering material 25 may be attached to the wrist band in a permanent, semi-permanent, or removable manner. For example, the covering material may be sewn, stapled, or glued to the wrist band to provide a permanent attachment. Alternatively, the covering material may be attached by Velcro, hooks, buttons, snaps, or other fasteners to provide a removable attachment.

The covering material is generally attached to allow access under the covering material to the electronic device. For example, if the covering material is in the form of a rectangle as shown in FIG. 1, two opposite sides 26 and 27 of the covering material are attached at the periphery to the wrist band 20 allowing access under the material at the two opposite sides not attached to the wrist band 20.

One side of the covering material (e.g. 26) may be permanently attached, e.g. sewn, and the opposite side (e.g. 27) may be removably attached, e.g. with Velcro. This allows access to the electronic device by lifting the covering material at the side with the Velcro.

The material covering the electronic device protects the device from harm such as being scratched. The material may be water-resistant. The material is lightweight and allows light from the electronic device, e.g. LED, shine or glow through the material in such a manner that the display can be read. Suitable materials include, but are not limited to polymeric fabrics made from polyesters and polyamides such as Nylon.

Although covering material 25 may be formed from water-resistant materials, advantages may be gained from forming covering material from an absorptive material. As discussed above, wristband 20 may be utilized to absorb and remove perspiration or other moisture. Electronic device 30, however, forms an area of apparel 10 that may not absorb or otherwise remove perspiration. The inclusion of covering material 25, when formed from an absorptive material, increases the surface area of apparel 10 that may be used to remove moisture.

The covering material may be a solid color, the same color or different color than the wristband, or provide a decorative element to the wrist band such as having a pattern or design.

The electronic device can be activated through the material by touch, e.g. depressing a display button. The electronic device may be activated by a button, for example, found on the top, side, or bottom of the device. In a particular embodiment, the electronic device is activated by a button located on the top of the device. The button may be any suitable device to operate the electronic device such as a push button.

The electronic device can be activated in other suitable manners such as voice recognition.

Figure 4:
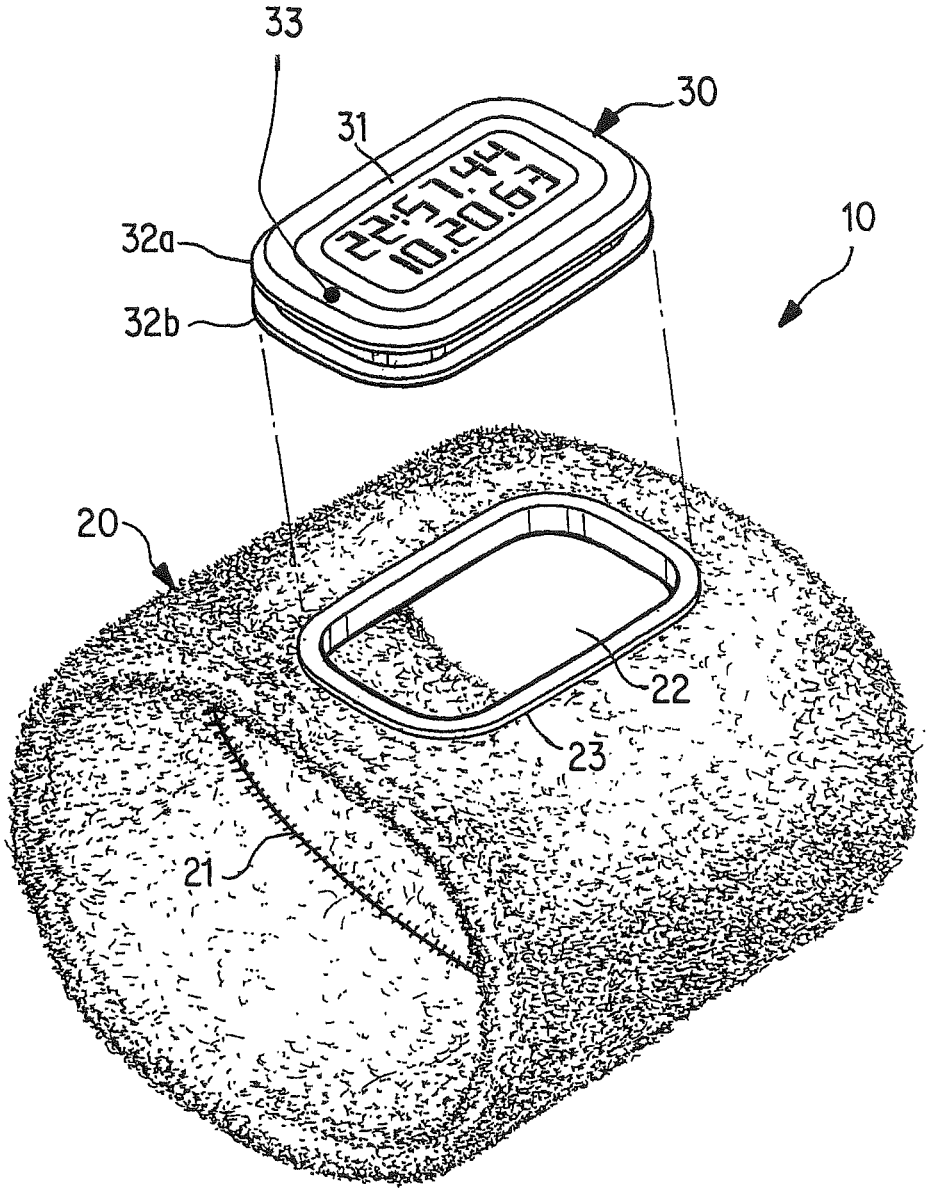
FIG. 4 is a first exploded perspective view of the first article of apparel in accordance with an aspect of the present invention without the covering material.

As shown in FIG. 4, wristband 20 defines an aperture 22 that extends through wristband 20. A reinforcing structure 23 formed from a semi-rigid material extends around aperture 22 and has a generally rectangular configuration that corresponds with exterior dimensions of electronic element 30. In addition to retaining a shape of aperture 22, reinforcing structure 23 limits fraying or unraveling of the textile material in areas of wristband 20 that are adjacent to aperture 22. The reinforcing structure 23 may be attached to the wristband in any suitable manner such as stitches or glue.

Reinforcing structure 22 may be formed from a variety of materials, including polymers and metals. Accordingly, suitable polymers for reinforcing structure 23 include nylon and polyurethane, and suitable metals for reinforcing structure 23 include steel, stainless steel, aluminum, and titanium, for example. In some embodiments, reinforcing structure 23 may also be formed from filaments, fibers, or yarns that reinforce aperture 22. In further embodiments reinforcing structure may be absent from wristband 20. In yet further embodiments where the textile material forming wristband 20 is primarily formed from a polymer material, reinforcing structure 23 may be formed from areas of the textile material that are adjacent to aperture 22 and melted to form a semi-rigid structure extending around aperture 22. Based upon the above discussion, therefore, aperture 22 and reinforcing structure 23 may exhibit a variety of configurations.

Aperture 22 is spaced inward from edges of the textile material forming a majority of wristband 20. In this configuration, the textile material forming wristband 20 extends entirely and continuously around aperture 22 to effectively define a hole through wristband 20. In some embodiments, however, aperture 22 may be an indentation in an edge of wristband 20 that receives electronic device 30.

Electronic device 30 performs the functions of a timing device that tracks and displays time, records split or lap times, or provides chronographic data. Any suitable electronic device may be utilized in the apparel.

For example, the electronic device depicted in co-pending application Ser. No. 10/987,577 may be utilized with the apparel. In this case, the primary components of electronic device 30 are a case 31, a pair of securing elements 32*a* and 32*b*, and circuitry within case 31. Case 31 has a generally box-shaped structure. Securing element 32*a* and 32*b* extends around the sidewall surfaces of case 31 adjacent the upper surface and lower surface, respectively. When positioned in the manner discussed above, a gap 35 is formed between securing elements 32*a* and 32*b*, as depicted in FIG. 4. Gap 35 effectively forms a peripheral indentation extending at least partially around an exterior of electronic device 30.

Case 31 provides a protective covering for circuitry within electronic device 30 and may be sealed to protect the circuitry from moisture in the form of perspiration or water. An upper portion/surface of case 31 is transparent so that the individual may view a display that is associated with circuitry within case 31. A pair of buttons or other activatable devices (not depicted) may also extend through case 31 in order to permit the individual to activate or switch between various functions associated with electronic device 30. The circuitry may include the display (e.g., a liquid crystal display, light emitting diode display, an analog-style display), a microprocessor, and a battery, for example, and effectively forms the portion of electronic device 30 that tracks and displays time, records split or lap times, or provides chronographic data.

Aperture 22, electronic device 30, and various other components of apparel 10 are discussed as having a rectangular configuration. In further aspects of the invention, aperture 22, electronic device 30, and the various other components of apparel 10 may have any suitable corresponding shapes that facilitates securing electronic device 30 to wristband 20 and separating electronic device 30 from wristband 20. For example, aperture 22 may have a circular, elliptical, triangular, square, or hexagonal shape, and case 31 may have a corresponding shape.

Although electronic device 30 is discussed above and depicted in the figures as performing the function of a timing device, electronic device 30 may be any of a plurality of suitable electronic devices. For example, electronic device 30 may be a heart rate monitor, a pedometer, a global positioning system (GPS) unit, altimeter, compass, thermometer, calculator, or communication device. In addition, electronic device 30 may perform the functions of two or more of the exemplar electronic devices discussed above. More particularly, electronic device 30 may be a combination of a timing device and GPS unit. Accordingly, the functions of electronic device 30 may vary significantly within the scope of the present invention.

Figure 5:
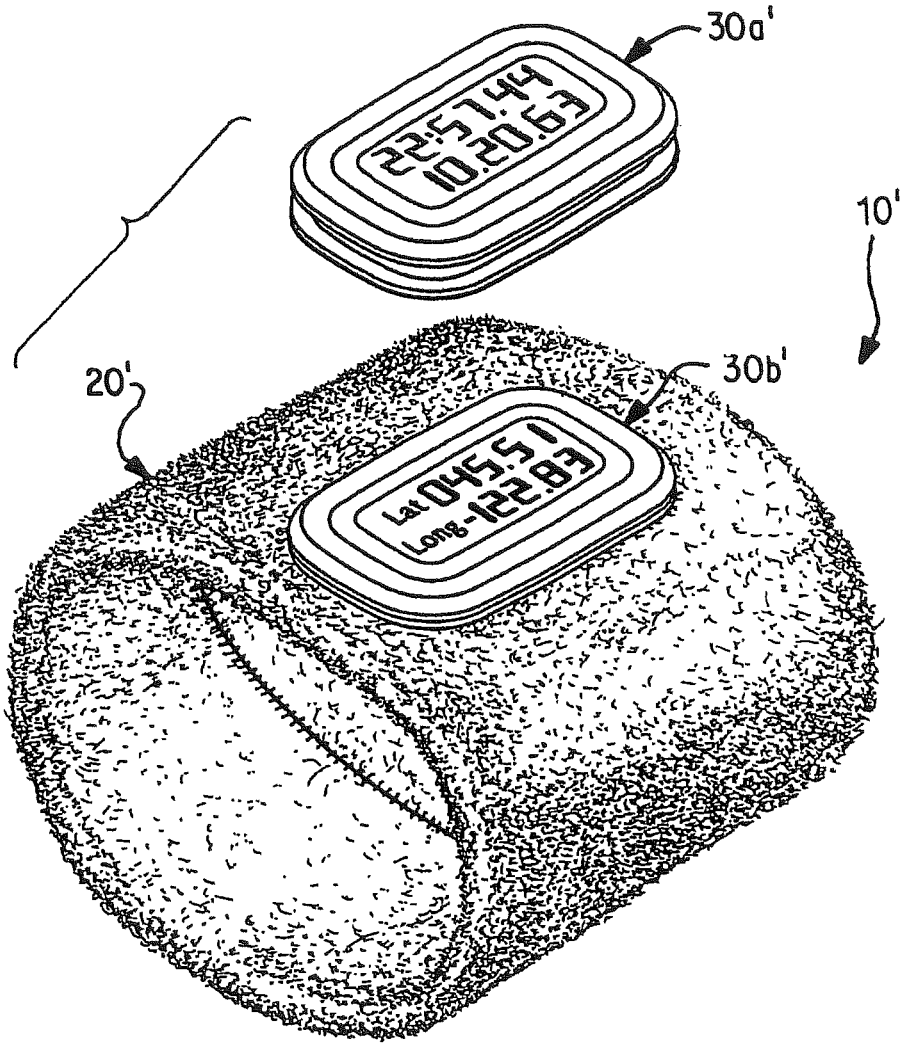
FIG. 5 is a perspective view of a second article of apparel in accordance with an aspect of the present invention without the covering material.

With reference to FIG. 5, an article of apparel 10' is depicted without the covering material as having a wristband 20' and a pair of electronic devices 30*a*' and 30*b*'. Wristband 20' exhibits a configuration that is substantially identical to wristband 20. Accordingly, wristband 20' is formed from a textile material and also defines an aperture with a reinforcing structure (not depicted). Although not depicted, wristband 20' may also include a material similar to covering material 25.

Whereas electronic device 30*a*' performs the function of a timing device and is substantially identical to electronic device 30, electronic device 30*b* performs the function of a GPS unit. During athletic activities where a timing device would be most beneficial, apparel 10' may be configured such that electronic device 30*a*' is received by the aperture in wristband 20'. During athletic activities where a GPS unit would be most beneficial, apparel 10' may be configured such that electronic device 30*b*' is received by the aperture in wristband 20'. Accordingly, apparel 10' has a configuration where one of electronic devices 30*a*' and 30*b*' may be utilized in combination with wristband 20', and electronic devices 30*a*' and 30*b*' may be freely interchanged by the individual. In further embodiments, electronic devices 30*a*' and 30*b*' may perform other functions, or additional electronic devices may be available for use by the individual. When wristband 20' is subjected to a washing process, however, both of electronic devices 30*a*' and 30*b*' may be removed from the aperture in wristband 20'.

Figure 6:
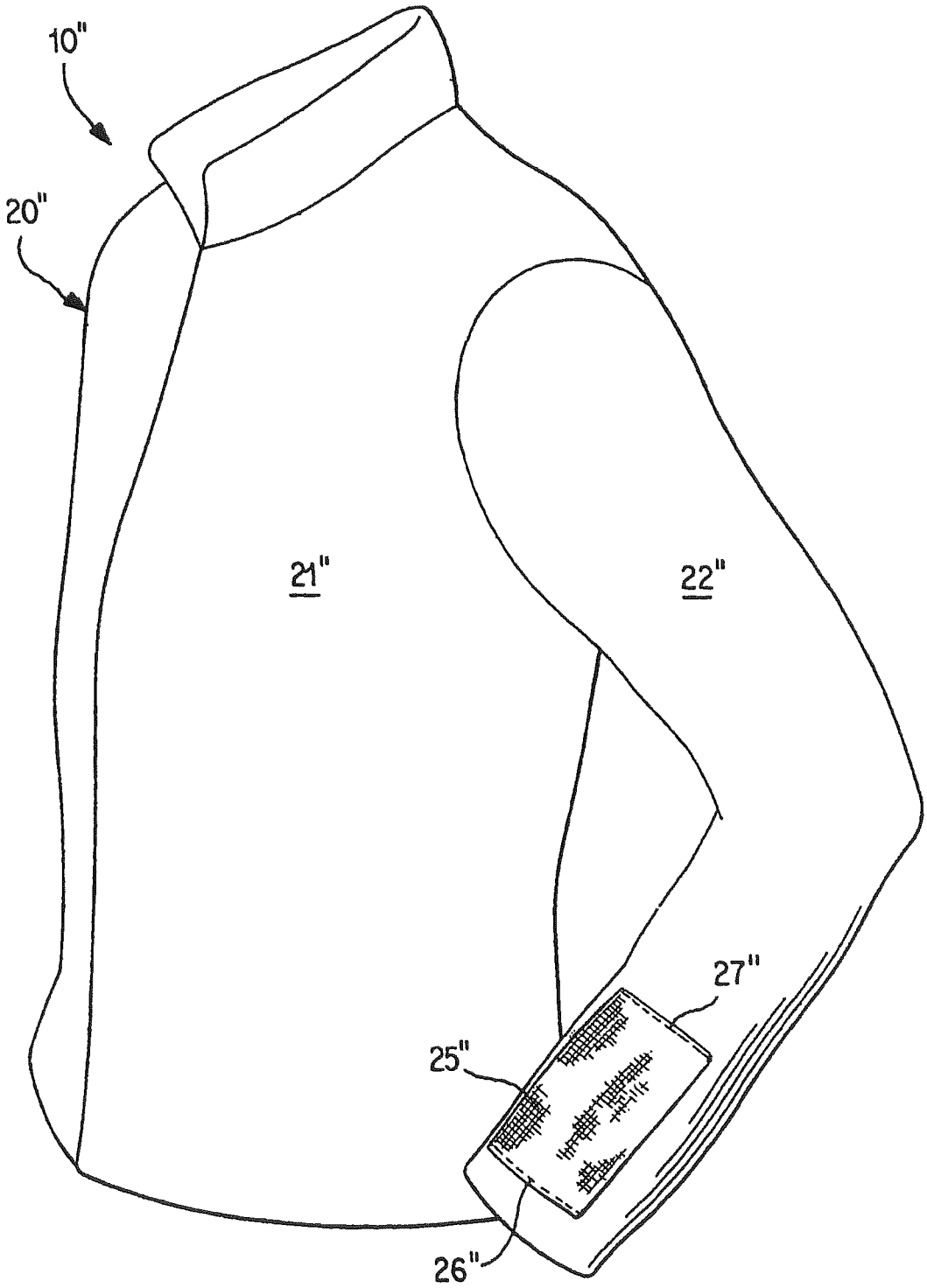
FIG. 6 is a perspective view of a third article of apparel in accordance with an aspect of the present invention.
Figure 7:
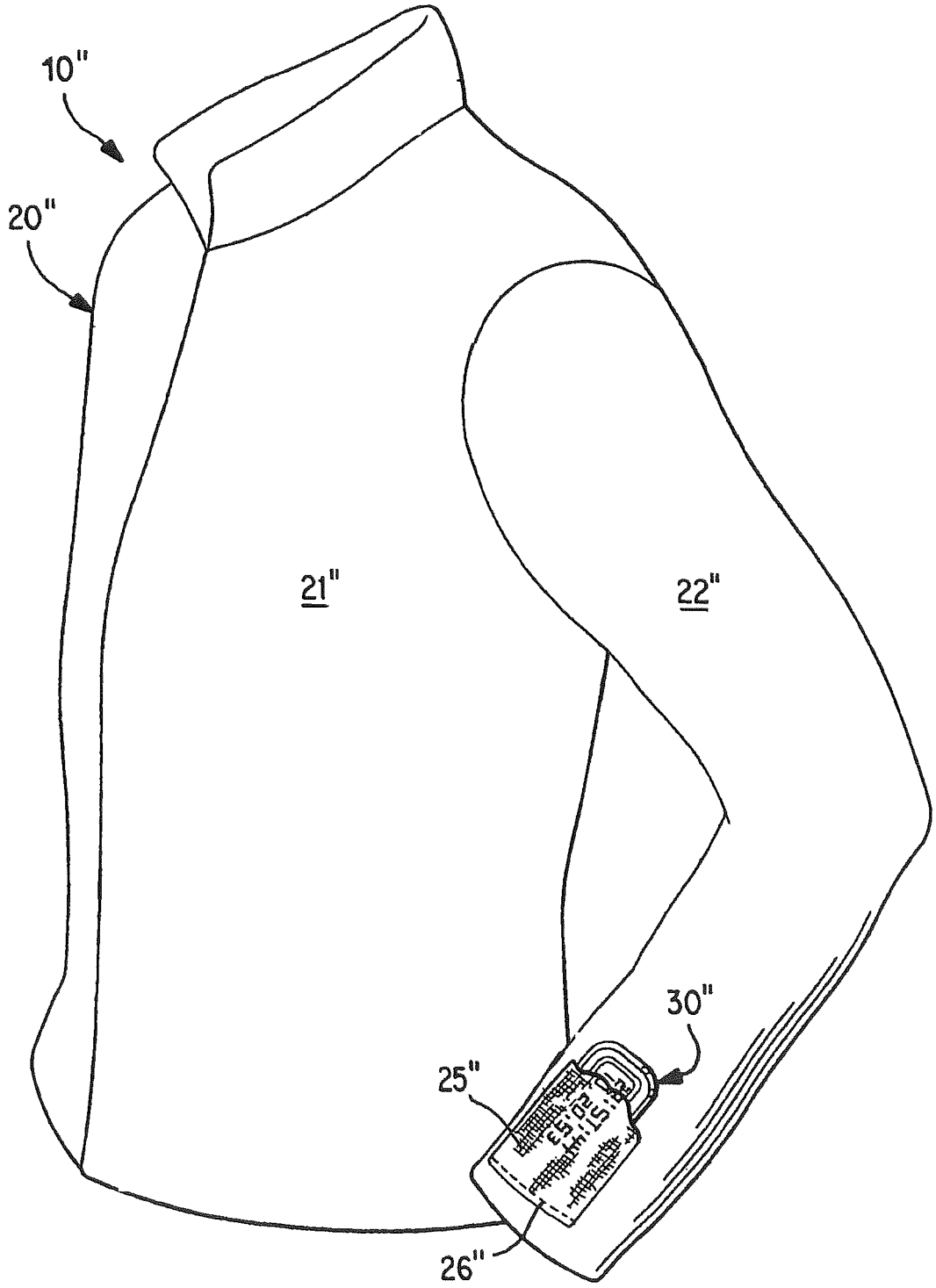
FIG. 7 is a perspective view of a third article of apparel in accordance with an aspect of the present invention wherein the covering material is partially cut away to view the hidden electronic device.

In addition to wristbands, various other types of apparel may incorporate the features of apparel 20 and 20', including gloves, shirts, pants, hats, socks, footwear, underwear, and coats, for example. With reference to FIG. 6, an article of apparel 10" is depicted as having a jacket 20" and covering material 25" which covers an electronic device 30" as shown in FIG. 7. Jacket 20" includes a torso region 21" and a pair of arm regions 22". One of arm regions 22" defines an aperture that receives electronic device 30". One of arm regions 22" defines an aperture that receives electronic device 30". As with apparel 10 and 10', electronic device 30" is removable from the aperture for purposes of washing jacket 22" or interchanging electronic device 30" with another electronic device. Although electronic device 30" is depicted as being located in a wrist area of one of arm regions 22", electronic device 30" may be positioned anywhere relative to jacket 20" in other aspects of the invention.

The covering material is generally attached to the apparel to allow access under the covering material to the electronic device. For example, if the covering material is in the form of a rectangle as shown in FIG. 6, two opposite sides 26" and 27" of the covering material are attached at the periphery to the wrist band allowing access under the material at the two opposite sides not attached to the wrist band.

Based upon the above discussion, any article of apparel may include an electronic device, such as electronic device 30. The apparel is at least partially formed from a material element that defines an aperture, and the electronic device is locatable within the aperture and removably-securable to the material element. A covering material covers the electronic device wherein when the electronic device is activated, a display is visible through the material.

The electronic device may be a timing device, such as a watch, or a global positioning system unit, for example. The apparel may be a wristband formed from a textile material or any of a variety of other types of apparel.

As shown in FIG. 4, case 31 contains securing element 32*a* and 32*b*, respectively. Within case 31 are appropriate components for the electronic device and display such as a light guide, a PCB assembly, a battery, positive battery contact, and a module frame for the components which may be a single piece or multiple pieces. The electronic device is activated or deactivated by depressing a button on the electronic device. The electronic device may have a reset button which may operated from the bottom of the device, for example.

The bottom edges of case 31 can be rounded to prevent sharp edges and provide a softer feel to the user.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of apparel comprising: a wristband comprising a polymer material, the wristband defining an aperture with a non-circular shape; an electronic device that is locatable within the aperture and securable to the wristband, the electronic device having the non-circular shape; and a covering material attached to the wristband and covering the electronic device, wherein the electronic device cannot be seen though the covering material except, when a display of the electronic device is activated, the display is visible through the covering material.

2. The article of apparel recited in claim 1, wherein the electronic device is a timing device or a global positioning system unit.

3. The article of apparel recited in claim 1, wherein at a least a portion of the covering material is permanently attached to the wristband.

4. The article of apparel recited in claim 1, wherein at least a portion of the covering material is removably attached to the wristband.

5. The article of apparel recited in claim 1, wherein a portion of the covering material is permanently attached to the wristband and another portion of the covering material is removably attached to the wristband.

6. An article of apparel comprising:

a wristband defining an aperture and comprising a polymer;

a reinforcing structure that is located within the aperture and secured to the wristband to form a peripheral indentation of the aperture, the reinforcing structure being formed from a material that is more rigid than the wristband; and an electronic device positionable and securable within the aperture, wherein the electronic device is separable from the wristband by disconnecting the reinforcing structure and the peripheral indentation; and a covering material attached to the wristband and covering the electronic device, wherein the electronic device cannot be seen though the covering material except, when a display of the electronic device is activated, the display is seen through the covering material.

7. The article of apparel recited in claim 6, wherein the electronic device is a timing device or a global positioning system unit.

8. The article of apparel recited in claim 6, wherein at a least a portion of the covering material is permanently attached to the wristband.

9. The article of apparel recited in claim 6, wherein at least a portion of the covering material is removably attached to the wristband.

10. The article of apparel recited in claim 6, wherein a portion of the covering material is permanently attached to the wristband and another portion of the covering material is removably attached to the wristband.

11. An article of apparel comprising:

a wristband;

an electronic device secured to the wristband, the electronic device including a display modifiable between an unilluminated and illuminated configuration; and a polymer covering element secured to the wristband and extending over the display of the electronic device, wherein the electronic device cannot be seen though the covering element except when the display is in the illuminated configuration.

* * * * *